United States Patent [19]

Bader

[11] 4,403,580

[45] Sep. 13, 1983

[54] SHUT-DOWN APPARATUS FOR DIESEL ENGINES

[76] Inventor: Hans Bader, Laroe Rd., Chester, N.Y. 10918

[21] Appl. No.: 218,427

[22] Filed: Dec. 19, 1980

[51] Int. Cl.[3] ..... F02M 63/02

[52] U.S. Cl. ..... 123/198 DB; 123/DIG. 11; 123/333

[58] Field of Search ..... 123/DIG. 11, 198 DB, 123/510, 514, 332, 333

[56] References Cited

U.S. PATENT DOCUMENTS

| | | | |
|---|---|---|---|
| 3,148,671 | 9/1964 | Bottorff | 123/198 DB |
| 4,296,718 | 10/1981 | Baugh et al. | 123/198 DB |
| 4,319,550 | 3/1982 | Ishii et al. | 123/198 DB |

FOREIGN PATENT DOCUMENTS

| | | |
|---|---|---|
| 2313860 | 9/1974 | Fed. Rep. of Germany . |
| 2311185 | 10/1976 | France . |

*Primary Examiner*—Ira S. Lazarus

*Attorney, Agent, or Firm*—Ralph R. Roberts

[57] ABSTRACT

The control circuit and apparatus is used and utilized with and by internal combustion engines that employ injector pumps for delivery of fuel to cylinders. Usually this arrangement includes metering and often the engine is a diesel engine. The fuel is delivered at a given flow rate which is in excess of the required flow and this excess is returned through a return conduit to a supply tank. The invention provides for electrically actuating apparatus for effectively terminating the supply of fuel to the injector pump. Five circuit arrangements are depicted, a first arrangement includes a solenoid actuated valve in the supply line and an electrically actuated return flow pump in the return line. A second arrangement has a return flow pump in the delivery line with the return flow pump, when actuated, having a greater flow capability than the transfer pump. A third arrangement employs two electrically actuated three-way valves and associated by-pass conduits in the delivery line. A fourth arrangement utilizes the solenoid actuated valve and return flow pump with a check valve in the return conduit. The fifth arrangement employs a three-way valve and a return flow pump in a by-pass line feeding to the delivery conduit.

6 Claims, 5 Drawing Figures

SHUT-DOWN APPARATUS FOR DIESEL ENGINES

BACKGROUND OF THE INVENTION

1. Field of the Invention

With reference to the classification of art as established in and by the United States Patent Office the present invention is believed to be found in the general class entitled, "Internal Combustion Engines" (Class 123) and in the subclasses thereunder entitled, "Compensating Devices . . . Balancing arrangements" (Subclasses 192 R and B).

DESCRIPTION OF THE PRIOR ART

The development and use of the diesel engine has become very widespread and in said engines the use of high pressure pumps and injector nozzles to feed diesel fuel into the piston chamber induces and promotes ignition. The diesel cycle is well known and is preferred in many instances because it does not require the use of dangerous gasoline. For this reason the use of diesel engines is particularly preferred in marine installations. Cut offs to prevent further engine run of the diesel engines includes throttling back and cutting off the flow of fuel to the engine. A manually operated cut off valve or solenoid actuated valve is conventionally used to cut off the flow of diesel fuel from a supply tank to the diesel engine. Often the engine runs on until the supply line is drained or depleted of fuel. This does not provide the substantially instantaneous stop contemplated by the hereinafter described circuits.

These novel circuits contemplate the cessation of flow of fuel to the injector pump. Five circuit arrangements are hereinafter more fully described and contemplate that a pump provides a reverse flow from the injector to the fuel storage tank. A cessation or shutting off of flow from the supply tank does not allow any flow into the injector system of the diesel engine.

SUMMARY OF THE INVENTION

This invention may be summarized, at least in part, with reference to its objects. It is an object of this invention to provide, and it does provide, a cessation of flow of diesel fuel from a supply tank to an engine. When a desired cessation of the operations of the engine is to occur the flow from the supply tank is stopped and diverted to a return flow pump so that fuel flow to the injector is stopped. There is provided a solenoid actuated valve which is actuated to shut off fuel flow. These circuits propose to stop the operation of a diesel engine from a remote position.

It is a further object of this invention to provide, and it does provide, a positive cessation of flow from the engine transfer pump and then by electrical signal the fuel flow from said transfer pump is diverted from an injection pump to return the fuel to the storage tank. This electrical signal and response provides a starving of the injection pump and a substantially immediate shut-down of the engine.

A plurality of circuits are disclosed and these circuit systems provide a conventional transfer pump and a return conduit in all embodiments to be hereinafter more fully described. It is contemplated that the flow of fuel to the injector pump is for each cylinder of the diesel engine. It is also contemplated that this diesel fuel will be fed to the engine by means of an injector pump. The inventor's circuits may employ a reversal pump in order to stop or cease the delivery of fuel to the injector pump. In all circuits a conventional return line is provided so that normal actuation and operation of the diesel system is achieved. The injector pump receives the supply of fuel which is then metered and fed to the cylinders. All the surplus fuel is then returned to the fuel tank.

In addition to the above summary the following disclosure is detailed to insure adequacy and aid in understanding of the invention. This disclosure, however, is not intended to cover this inventive concept no matter how it may later be disguised by variations in form or additions of further improvements. For this reason there has been chosen specific embodiments of circuit apparatus for delivery of fuel to an engine with an electrical control and shut off for a shut down and showing a preferred means for providing circuits for a diesel engine. These specific circuits have been chosen for the purposes of illustration and description as shown in the accompanying drawing wherein:

BRIEF DESCRIPTION OF THE DRAWINGS

In the following description and in the claims various details are identified by specific names for convenience. These names are intended to be generic in their application. Corresponding reference characters refer to like members throughout the five figures of the drawings.

Figure 1:
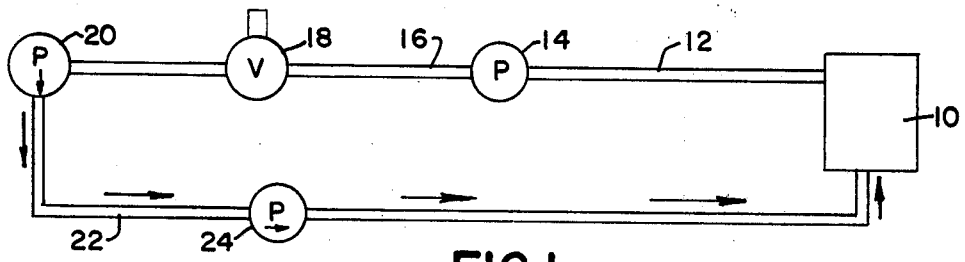
FIG. 1 represents a circuit diagram providing a means for the cessation of fuel supply to the injector pump employing an electrically actuated solenoid and a return flow electrically actuated fuel pump.

Circuit Diagram of FIG. 1

Referring next to the drawing and in particular to FIG. 1, it is to be noted that a fuel tank 10 is connected to a delivery line or conduit 12 leading to an engine transfer pump 14 and thence to conduit or line 16. A normally open solenoid valve 18 is in this delivery line and is actuated by low voltage D.C. such as twelve volts. This solenoid valve is placed in the conduit or line 16 between engine transfer pump 14 and an injection pump 20 which delivers diesel fuel in determined and metered quantities to the cylinders in the diesel engine, not shown. An excess quantity of diesel fuel is always delivered to the injection pump 20 to accommodate its requirements for the operation of the diesel engine. Surplus fuel is returned from the injector pump 20 through a return line or conduit 22 to the fuel tank 10.

In the circuit of FIG. 1 a fuel pump 24 is placed in the return line but is actuated only when the solenoid valve 18 is actuated to cut-off fuel from the transfer pump 14. This pump 24 moves and removes all diesel fuel from the injector pump 20 and returns said fuel to the fuel tank 10 causing substantially a simultaneous cessation of the running of the diesel engine.

Figure 2:
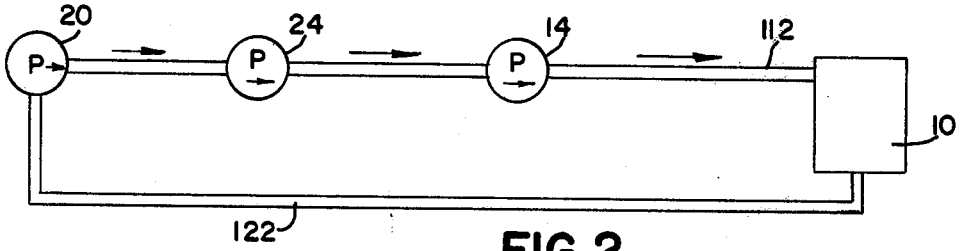
FIG. 2 represents a circuit diagram providing means by which a fuel pump has a reversing capability and is disposed to overcome a transfer pump and delivery system.

Circuit Diagram of FIG. 2

In FIG. 2 a circuit similar to that of FIG. 1 utilizes fuel tank 10; engine transfer pump 14 and injector pump 20. Electrically actuated fuel pump 24, rather than as in FIG. 1, is placed in conduit 112 and has a greater capacity of fuel flow than the engine transfer pump 14. When fuel pump 24 is energized the flow of fuel from tank 10 is reversed to overcome the delivery capability of transfer pump 14. In this manner the fuel delivered to the injector pump 20 is cut-off and the running of the diesel engine is, of course, stopped.

In use, it is contemplated that a non-operating electrical fuel pump 24 allows a normal supply of diesel fuel to flow from tank 10 through transfer pump 14 to the injector pump 20. When it is desired to stop the engine and the delivery of fuel to the injector pump 20, fuel pump 24 is energized and a reverse flow of fuel in line 112 occurs because fuel pump 24 has a greater capability than that of the transfer pump 14 so that an immediate shortage of fuel to the injector pump 20 occurs and the engine is shut down or stopped.

Figure 3:
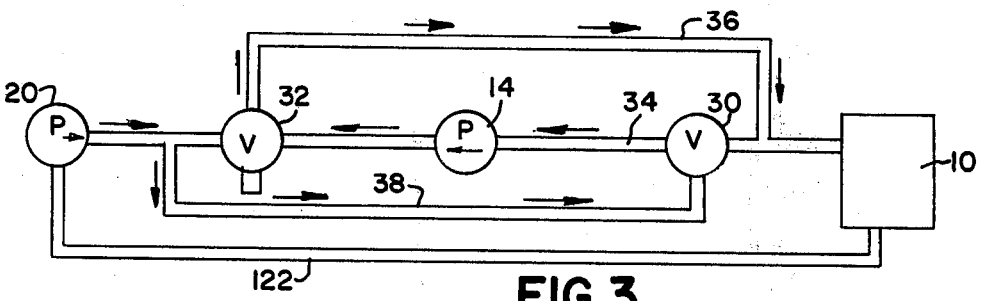
FIG. 3 represents a circuit diagram wherein an engine transfer pump conduit line also includes two three-way electrically actuated valves in the delivery line.

Circuit Diagram of FIG. 3

Referring next to FIG. 3 the fuel tank 10; transfer pump 14; and injector pump 20 are like that as disclosed in FIG. 1, but a return line 122 is absent the presence of reverse flow fuel pump 24. As shown there are two, three-way valves 30 and 32 which are mounted in a delivery line 34 from fuel tank 10 to injector pump 20. The transfer pump 14 is in this line 34 and a bypass or conduit line 36 extends from three-way valve 32 and enters line 34 between three-way valve 30 and tank 10. Bypass line 38 goes from three-way valve 32 to the connection between valve 30 and injector pump 20.

In operation it is contemplated that the two, three-way valves 30 and 32 are energized and/or deenergized at the same time. In a deenergized condition fuel flow from tank 10 to the engine transfer pump 14 and the injector pump 20 occurs in the usual manner with return line 122 carrying the excess fuel to the injector pump 20. When the three-way valves 30 and 32 are actuated they redirect the fuel flow so engine transfer pump 14 carries fluid from the injector pump 20 through and back by line 38 to valve 30 thence to the engine transfer pump 14 thence to valve 32 then line 36 to tank 10.

In normal operation it is anticipated that the engine transfer pump 14 will continue to deliver fuel to injector pump 20 but when the valves 30 and 32 are actuated fluid flow from pump 20 and line 38 flows into the engine transfer pump 14 thence fluid flow is from said engine to valve 30 and transfer pump moves fluid through the three-way valve 32 and into the line 36 and then back to the fuel tank 10. In this way any fuel present at or in the injector pump 20 is removed through line 38 by engine transfer pump 14.

Figure 4:
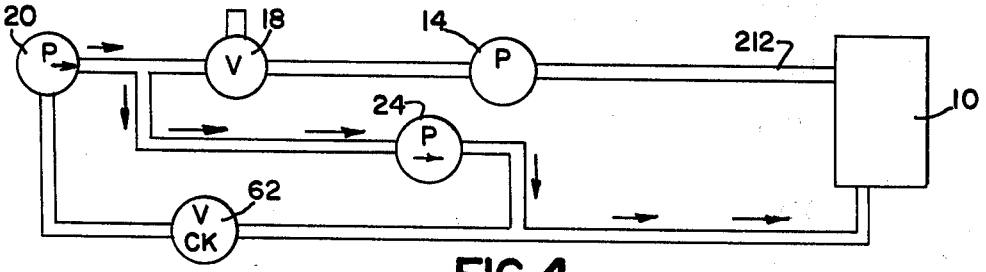
FIG. 4 represents a circuit diagram using an electrically actuated solenoid and a return flow fuel pump.

Circuit Diagram of FIG. 4

In FIG. 4 the fuel tank 10; injector pump 20; engine transfer pump 14 and solenoid valve 18 are like that of FIG. 1. Line or conduit 12 is now identified as 212 with solenoid valve 18 now in said conduit. Electrical fuel pump 24 is mounted in a bypass conduit 60 extending from line 212 after solenoid valve 18 and into return line 222. Said line 222 provides not only a return flow but also has a check valve 62. This check valve insures that no return flow of fluid reaches pump 20 from actuation of pump 24.

In operation it is anticipated that the solenoid valve 18 is normally open to deliver diesel fuel through the engine transfer pump 14. The delivered fuel from the tank 10 is carried through line 212 through solenoid valve 18 to the injector pump 20. When it is desired to shut down the diesel engine the solenoid valve 18 is actuated and prevents flow from pump 24. Check valve 62 is also actuated to injector pump 20. Line 112 is shut off and by the actuation of the solenoid valve 18 in line 222 from the injector pump 20 is closed as to influent flow by valve 62. Fuel pump 24 is activated and the fuel drawn from the injector pump 20 is returned to the fuel tank 10.

Figure 5:
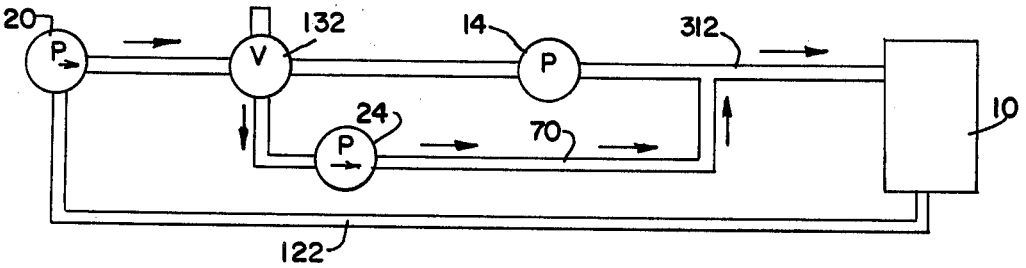
FIG. 5 represents a circuit diagram in which a solenoid and a three-way valve utilizes a reverse flow fuel pump for a return of the diesel fuel.

Circuit Diagram of FIG. 5

Referring next and finally to FIG. 5, it is to be noted that fuel tank 10; engine transfer pump 14; solenoid valve 18 and the injector pump 20 are the same or similar to that of FIG. 1. A three-way valve 132 is placed in this new line 312 and return line 122 is like that of FIG. 2. Fuel pump 24 carries fuel from the three-way valve 132 through the line 70 and back to the fuel tank 10.

Flow from the fuel tank 10 through engine transfer pump 14 thence through an open three-way valve 132 to injector pump 20 operates in the usual manner and the return line 122 carries any surplus fuel back to the fuel tank 10. When it is desired to shut the diesel engine down, solenoid actuated three-way valve 132 and fuel pump 24 are energized and flow from the engine transfer pump 14 is diverted by the actuation of the three-way valve 132. Fuel from the injector pump 20 flows as indicated by the arrows from the injector pump 20 to the fuel tank 10. The actuation of pump 24 causes a flow of fuel in line 70. The desired cessation of operation of injector pump 20 and associated diesel engine is easily accomplished by actuating the D.C. to the three-way valve 132 and fuel pump 24. The engine transfer pump 14 may or may not be shut-off but any fuel moving to said pump 14 is stopped from flowing to injector pump 20 and the engine by the actuation of the three-way valve 132 and the fuel pump 24 which removes fuel from the injector pump 20 causing an absence of starvation of fuel which will stop the engine.

The circuit diagrams above described depict the several methods for making a positive shut-down of a diesel engine. The term "dieseling" for a run-on of an engine in a gasoline powered car is well known and the tendency for diesel engines to run until out of fuel is also well known. The present circuits provide a substantially instantaneous shut-off of the diesel engine. The delivery of any diesel fuel to the injector pump 20 also is combined with a shut-off of fuel to said pump. Preferably an additional reverse flow pump 24 is employed but other circuits employing three-way valves may be used. No matter the circuit, the remote control of a shut-down is positively and easily achieved. The preferred embodiment is with Direct Current electricity of low voltage such as twelve volts but this is not to preclude the use of pressurized oil or air. The use of pressurized fluid contemplates other motors or storage means not necessarily present in systems with a diesel engine.

Although the above circuits are contemplated for use in marine installations said circuits for a diesel engine may be used in other applications.

Terms such as "open", "closed" and the like are applicable to the circuits shown and described in conjunction with the drawing. These terms are merely for the purposes of description and do not necessarily apply to the position in which the apparatus and circuits for shutting down a diesel engine may be constructed or used.

While particular circuits for a shut down control have been shown and described it is to be understood the invention is not limited thereto and protection is sought to the broadest extent the prior art allows.

What is claimed is:

1. A fuel supply control circuit and apparatus in which fuel from a supply tank is delivered by a transfer pump to an injector pump by which fuel is delivered at a given flow rate through a supply conduit and delivered in a metered condition to an internal combustion engine and with any excess fuel delivered to and not used by the injector pump returned to the fuel tank by and through a return conduit, said circuit and apparatus further including signal means for terminating the flow of fuel to the injector pump by and with an electrically actuated shut-off valve in the supply conduit from transfer pump to the injector pump and there is provided in said return conduit an electrically actuated return flow fuel pump, both the shut-off valve and return flow fuel pump being actuated in response to the same signal actuation of said intended flow of fuel to the injector pump being affectively terminated and the engine ceases to run due to an absence of fuel.

2. A fuel supply control circuit and apparatus in which fuel from a supply tank is delivered by a transfer pump to an injector pump by which fuel is delivered at a given flow rate through a supply conduit and delivered in a metered condition to an internal combustion engine and with any excess fuel delivered to and not used by the injector pump returned to the fuel tank by and through a return conduit, said circuit and apparatus further including electrical signal means for terminating the flow of fuel to injector pump which includes a return flow fuel pump in the supply conduit, said return flow pump electrically actuated and in an non-operating condition allows the downstream flow of fuel to move through said conduit with little or no restriction and when said return flow pump is actuated to have a greater flow capability than the transfer pump so that the return fuel flow is upstream and said pump is effective in moving the fuel from the injector pump so that said intended fuel flow is effectively terminated and the engine ceases to run due to an absence of fuel.

3. A fuel supply control circuit as in claim 2 in which the return flow pump is placed in the supply conduit between the transfer pump and the injector pump.

4. A fuel supply control circuit and apparatus in which fuel from a supply tank is delivered by a transfer pump to an injector pump by which fuel is delivered at a given flow rate through a supply conduit and delivered in a metered condition to an internal combustion engine and with any excess fuel delivered to and not used by the injector pump returned to the fuel tank by and through a return conduit, said circuit and apparatus further including electrical signal means for terminating the flow of fuel to the injector pump which includes two three-way valves placed in and flow connected to and through the supply conduit, both of said three-way valves being electrically actuated for substantially simultaneous operation in response to said signal means, one valve being placed in the supply conduit between the transfer pump and the injector pump and flow connected so that in an actuated condition the fuel in said conduit is carried in a first by-pass conduit from the three-way valve to the supply conduit and at a point near to the supply tank, and with the other three-way valve being placed in the supply conduit between the fuel tank and the transfer pump and downstream from the input connection to this conduit from the first by-pass conduit, this three-way valve flow connected to a second by-pass conduit so that when actuated the fuel is drawn from the supply conduit at a point downstream from the first three-way valve and to said second three-way valve to fuel flow toward the transfer pump to effectively terminate the flow of fuel and the engine ceases to run due to an absence of fuel.

5. A fuel supply control circuit and apparatus in which fuel from a supply tank is delivered by a transfer pump to an injector pump by which fuel is delivered at a given flow rate through a supply conduit and delivered in a metered condition to an internal combustion engine and with any excess fuel delivered to and not used by the injector pump returned to the fuel tank by and through a return conduit, said circuit and apparatus further including electrical signal means for terminating the flow of fuel to the injector pump which includes an electrically actuated shut-off valve in the supply conduit from the transfer pump to the injector pump and there is provided a by-pass conduit having an electrically actuated return flow fuel pump, said by-pass conduit connecting the supply conduit between the shut-off valve and into the return conduit midway of its ends and with a check valve in the return conduit between the injector pump and the connection of the by-pass to the return conduit, the check valve preventing fuel flow in the return conduit toward the injector pump and with an electrical signal the shut-off valve and return flow pump are energized so as to effectively terminate fuel flow and the running of the engine and return the unused fuel to the supply tank.

6. A fuel supply control circuit and apparatus in which fuel from a supply tank is delivered by a transfer pump to an injector pump by which fuel is delivered at a given flow rate through a supply conduit and delivered in a metered condition to an internal combustion engine and with any excess fuel delivered to and not used by the injector pump returned to the fuel tank by and through a return conduit, said circuit and apparatus further including electrical signal means for terminating the flow of fuel to the injector pump which includes an electrically actuated three-way valve disposed in the supply conduit and downstream from the supply pump, the output of said actuated three-way valve being flow connected to a by-pass conduit that includes an electrically actuated return flow pump, the output end of this by-pass conduit connected to the supply at a point upstream of the transfer pump so as to return to said storage tank that fuel destined for the injector pump and in response to said signal actuation said intended flow of fuel to the injector pump being effectively terminated and the engine ceases to run due to an absence of fuel.

* * * * *